US007922519B1

(12) United States Patent
Sun

(10) Patent No.: US 7,922,519 B1
(45) Date of Patent: Apr. 12, 2011

(54) RJ-45 CONNECTOR

(75) Inventor: Zheng-Heng Sun, Taipei Hsien (TW)

(73) Assignee: Hon Hai Precision Industry Co. Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/854,312

(22) Filed: Aug. 11, 2010

(51) Int. Cl.
*H01R 3/00* (2006.01)

(52) U.S. Cl. ..... 439/490; 439/910

(58) Field of Classification Search ..... 439/488–491, 439/910
See application file for complete search history.

(56) References Cited

U.S. PATENT DOCUMENTS 6,921,284 B2 * 7/2005 Sirichai et al. ..... 439/490
7,101,219 B1 * 9/2006 Huang ..... 439/490

* cited by examiner

*Primary Examiner* — James Harvey
(74) *Attorney, Agent, or Firm* — Clifford O. Chi

(57) ABSTRACT

A connector includes a main body, and a cable electrically connected to a rear end of the main body. An elastic latch is formed on a top of the main body. Two protrusions are formed on a rear portion of the top of the main body. A surface of each protrusion is coated with reflecting material, slanted, and opposite to the cable.

9 Claims, 3 Drawing Sheets

RJ-45 CONNECTOR

CROSS-REFERENCE OF RELATED APPLICATIONS

Relevant subject matter is disclosed in a co-pending U.S. patent application, titled "RJ-45 CONNECTOR", with the application Ser. No. 12/825,309, and in a co-pending U.S. patent application Ser. No. 12/859,284 entitled "RJ-45 connector", which are assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
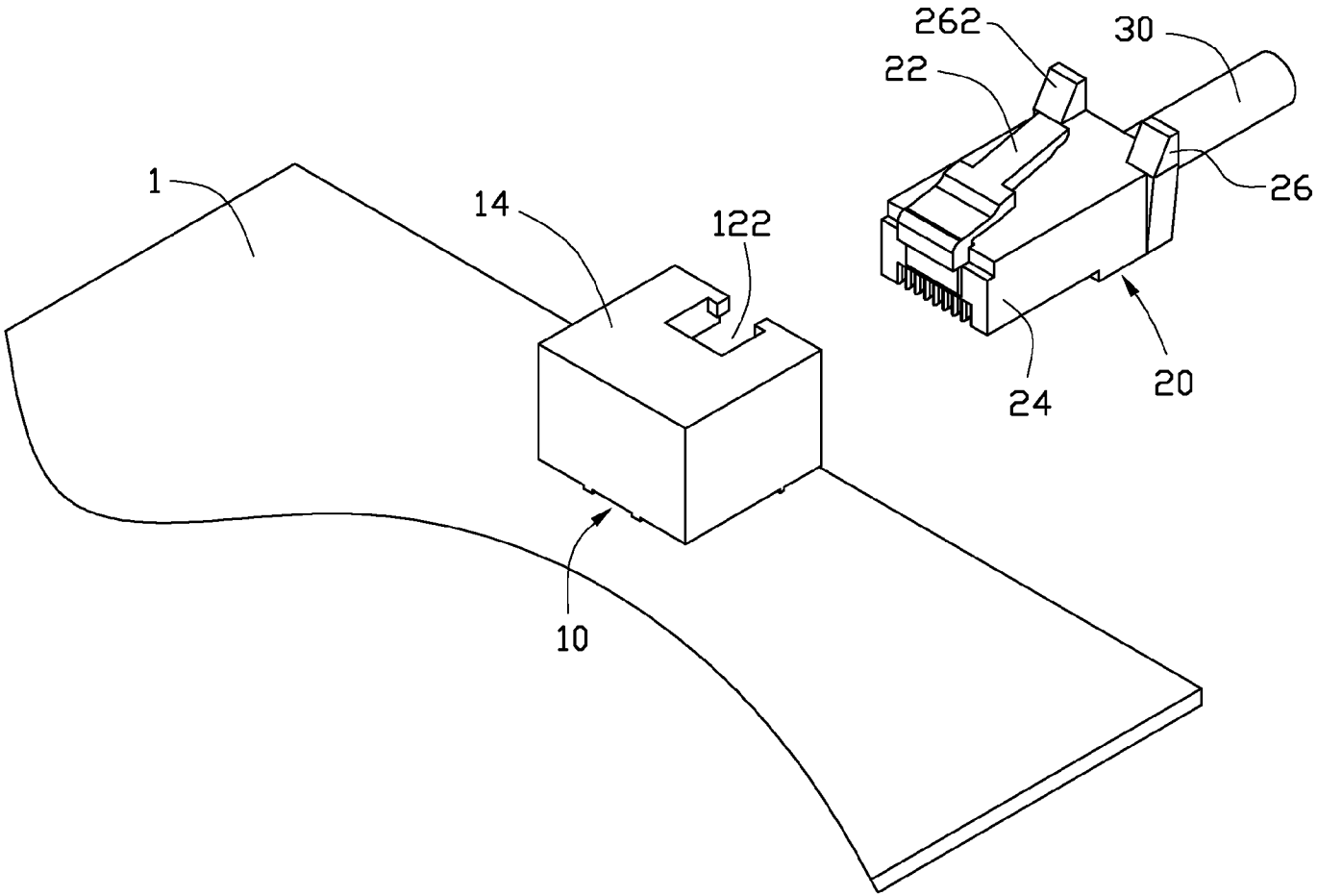
FIG. 1 is an exploded, isometric view of one embodiment of a Registered Jack-45 (RJ-45) connector and a motherboard.
Figure 2:
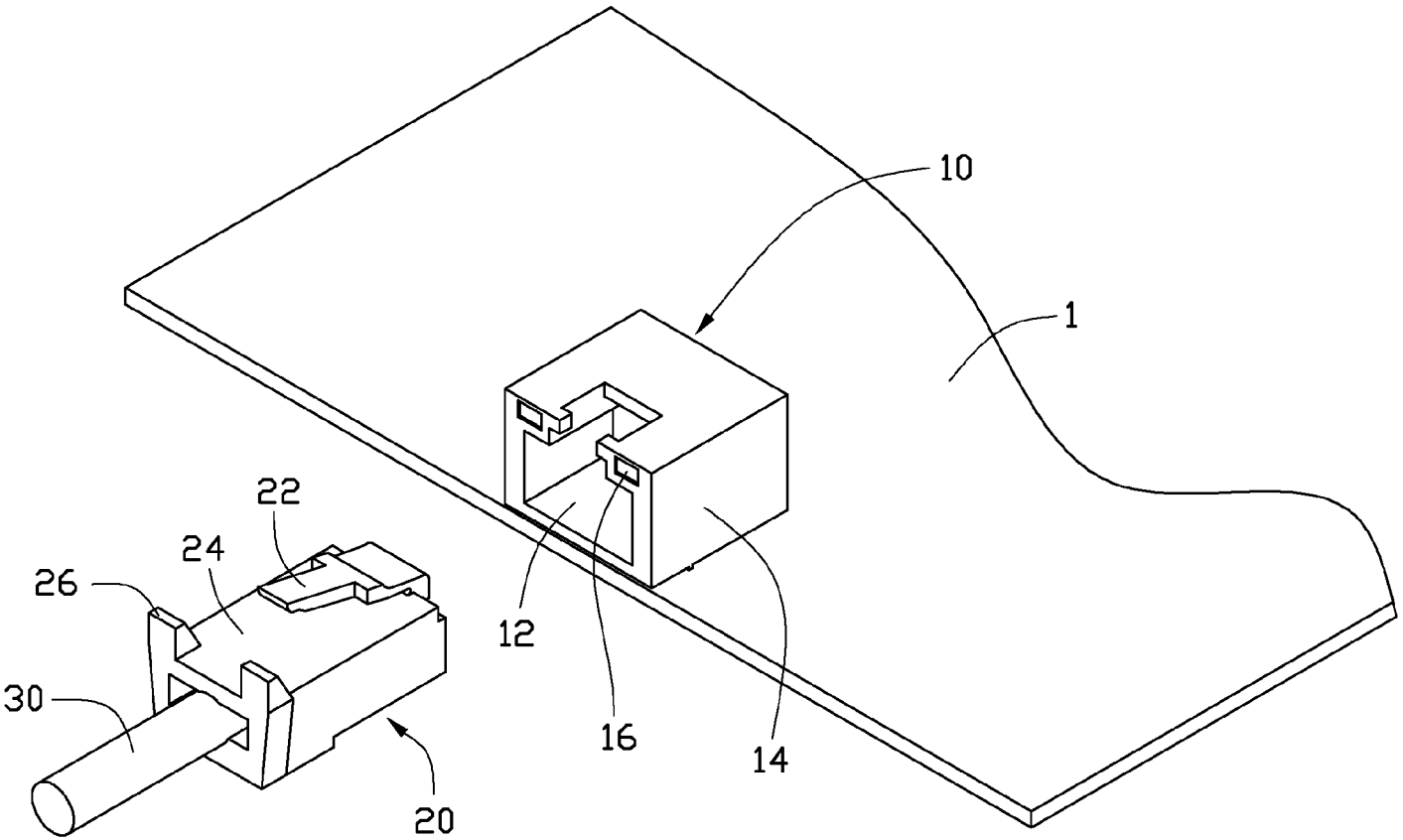
FIG. 2 is similar to FIG. 1, but viewed from another perspective.

Referring to FIGS. 1 and 2, an embodiment of a Registered Jack-45 (RJ-45) connector 20 includes a main body 24, and a cable 30 extending from a first end of the main body 24.

An elastic latch 22 is formed on a second end of the main body 24 opposite to the first end, and extends slantingly above a top surface of the main body 24 toward the first end. Two wedge-shaped protrusions 26 are formed on the top surface of the main body 24, adjacent to the first end. The elastic latch 22 is positioned between the two protrusions 26. A surface of each protrusion 26 toward the second end is a slanted surface 262 coated with a reflective material, such as mirrored glass, or shiny fabric or film.

The RJ-45 connector 20 can be inserted into a connector 10 of a motherboard 1. The connector 10 includes a housing 14 which defines a receiving space 12. An opening 122 is defined in a top of the housing 14, communicating with the receiving space 12. Two light emitting diodes 16 are mounted to the housing 14 and positioned at opposite sides of the opening 122 and the receiving space 12.

Figure 3:
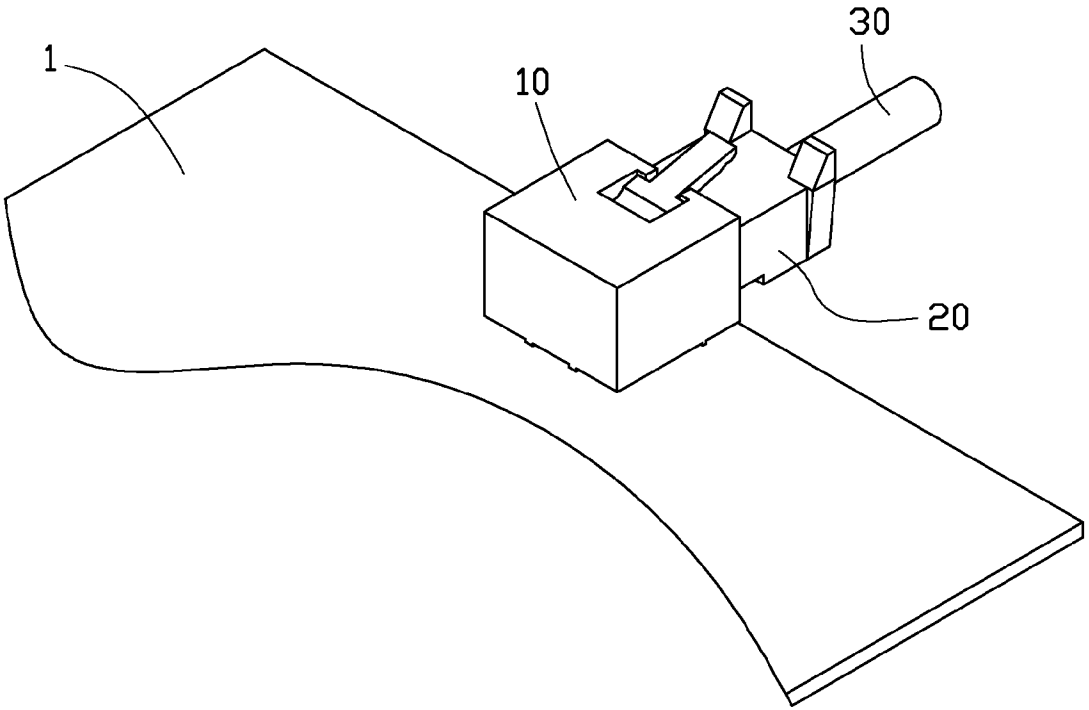
FIG. 3 is an assembled, isometric view of the RJ-45 connector and the motherboard of FIG. 1.

Referring to FIG. 3, in assembly, the RJ-45 connector 20 is inserted into the receiving space 12 of the connector 10. The elastic latch 22 is engaged in the opening 122. The slanted surface 262 of each protrusion 26 substantially faces a corresponding light emitting diode 16 and reflects light generated by the corresponding light emitting diode 16. Thereby, the light can be seen easily.

It is believed that the present embodiments and their advantages will be understood from the foregoing description, and they will be apparent that various changes may be made thereto without departing from the spirit and scope of the description or sacrificing all of their material advantages, the examples hereinbefore described merely being exemplary embodiment.

What is claimed is:

1. A Registered Jack-45 (RJ-45) connector matching a connector with two light emitting diodes, the RJ-45 connector comprising:

a main body to be engaged with the connector, and comprising at least one protrusion extending from the main body, wherein a surface of each of the at least one protrusion is coated with reflective material, slanted, and operable to substantially face one of the light emitting diodes when the RI-45 connector is connected with the connector.

2. The RJ-45 connector of claim 1, the main body comprising two protrusions, wherein the slanted surface of each protrusion coated with reflective material operable to substantially face a corresponding light emitting diode when the RI-45 connector is connected with the connector.

3. The RJ-45 connector of claim 1, further comprising a cable extending from an end of the main body.

4. The RJ-45 connector of claim 1, wherein the main body further comprises an elastic latch extending from the main body opposite to the cable to engage with the connector.

5. The RJ-45 connector of claim 1, wherein the reflective material is mirrored glass, or shiny fabric or film.

6. A Registered Jack-45 (RJ-45) connector assembly comprising:

a first connector defining a receiving space and comprising at least a light emitting diode at a side of the receiving space; and a second connector comprising a main body comprising a first end engaged in the receiving space of the first connector, and a second end opposite to and exposed from the first connector, at least one protrusion extending from the second end, each protrusion comprising a surface coated with reflective material, slanted, and operable to substantially face one of the light emitting diodes when the RI-45 connector is connected with the connector.

7. The RJ-45 connector assembly of claim 6, wherein the first connector comprises two light emitting diodes at opposite sides of the receiving space, the main body of the second connector comprises two protrusions extending from the second end, each protrusion comprising a slanted surface facing corresponding one of the light emitting diodes, to reflect light emitted by the corresponding light emitting diode.

8. The RJ-45 connector assembly of claim 6, wherein the first connector defines an opening communicating with the receiving space; the main body further comprises an elastic latch slantingly extending from the first end of the main body towards the second end, to engage in the opening.

9. The RJ-45 connector assembly of claim 6, wherein the protrusion is positioned on a top surface of the main body.

* * * * *